US009664489B2

(12) United States Patent
Poehlman et al.

(10) Patent No.: US 9,664,489 B2
(45) Date of Patent: May 30, 2017

(54) HAND DEPRIMER

(71) Applicant: Battenfeld Technologies, Inc., Columbia, MO (US)

(72) Inventors: Michael Poehlman, Columbia, MO (US); James Tayon, Moberly, MO (US); Dennis W. Cauley, Jr., Booneville, MO (US); Michael Cottrell, Columbia, MO (US); Tim Kinney, Columbia, MO (US); Matthew Kinamore, Columbia, MO (US); James Gianladis, Harrisburg, MO (US); Adam J. Birk, Hallsville, MO (US)

(73) Assignee: Battenfeld Technologies, Inc., Columbia, MO (US)

( * ) Notice: Subject to any disclaimer, the term of this patent is extended or adjusted under 35 U.S.C. 154(b) by 0 days.

(21) Appl. No.: 14/994,806

(22) Filed: Jan. 13, 2016

(65) Prior Publication Data

US 2016/0209193 A1 Jul. 21, 2016

Related U.S. Application Data

(60) Provisional application No. 62/103,927, filed on Jan. 15, 2015.

(51) Int. Cl.
*F42B 33/04* (2006.01)
*F42B 33/10* (2006.01)

(52) U.S. Cl.
CPC ..... *F42B 33/04* (2013.01); *F42B 33/10* (2013.01)

(58) Field of Classification Search
CPC ..... F42B 33/04; F42B 33/06; F42B 33/10
USPC ..... 86/24, 28, 33, 37, 40
See application file for complete search history.

(56) References Cited

U.S. PATENT DOCUMENTS

| | | | | | |
|---|---|---|---|---|---|
| 139,674 | A | * | 6/1873 | Holmes | F42B 33/04 86/37 |
| 387,868 | A | | 8/1888 | Farrow | |
| 536,045 | A | * | 3/1895 | Ripley | F42B 33/04 86/37 |
| 2,314,115 | A | | 12/1941 | Albree | |
| 3,025,743 | A | * | 3/1962 | Cecchi | F42B 39/10 279/114 |
| 3,180,204 | A | * | 4/1965 | Sampson | F42B 33/04 86/37 |
| 3,555,959 | A | | 1/1971 | Lee | |
| 4,133,249 | A | * | 1/1979 | Bachhuber | F42B 33/10 86/23 |
| 4,142,441 | A | | 3/1979 | Schaenzer | |
| 4,176,583 | A | * | 12/1979 | Lage | F42B 33/10 86/24 |
| 4,189,980 | A | * | 2/1980 | Schaenzer | F42B 33/02 86/24 |
| 4,537,112 | A | | 8/1985 | Dabonde | |
| 4,549,463 | A | * | 10/1985 | Raiha | F42B 33/04 86/36 |
| 4,566,366 | A | | 1/1986 | Lee | |

(Continued)

*Primary Examiner* — Bret Hayes
(74) *Attorney, Agent, or Firm* — Senniger Powers LLP

(57) ABSTRACT

A hand deprimer for removing a spent primer from an ammunition case. The deprimer is universal in that it is readily adjustable to remove spent primers from a wide variety of sizes and types of cases. The deprimer is configured for securing cases of various sizes and types in operative alignment with features that eject the primer from the base of the case.

25 Claims, 8 Drawing Sheets

(56) References Cited

U.S. PATENT DOCUMENTS

| | | | | | |
|---|---|---|---|---|---|
| 4,732,073 | A * | 3/1988 | Semon | F42B 33/04 | 15/104.2 |
| 5,333,367 | A * | 8/1994 | Ashbrook | B25B 27/02 | 29/275 |
| 5,649,465 | A * | 7/1997 | Beebe | F42B 33/10 | 86/1.1 |
| 5,698,809 | A | 12/1997 | Holt | | |
| 7,806,034 | B1 * | 10/2010 | Lee | F42B 33/001 | 86/37 |
| 8,511,213 | B2 | 8/2013 | Harvey | | |
| 9,146,087 | B2 | 9/2015 | Cottrell et al. | | |
| 2004/0025677 | A1 * | 2/2004 | Koch | F42B 33/10 | 86/24 |
| 2010/0275762 | A1 * | 11/2010 | Koch | F42B 5/067 | 86/43 |
| 2012/0160081 | A1 * | 6/2012 | Beebe | F42B 33/10 | 86/24 |
| 2015/0198429 | A1 * | 7/2015 | Mirza | F42B 33/04 | 86/37 |

* cited by examiner

HAND DEPRIMER

CROSS-REFERENCE TO RELATED APPLICATION

This application claims priority to U.S. Provisional Patent Application No. 62/103,927, filed Jan. 15, 2015, which is hereby incorporated by reference in its entirety.

FIELD

The present disclosure generally relates to an apparatus for preparing ammunition casing for re-loading, and more particularly to an apparatus for removing spent primers from ammunition casings having a variety of sizes.

BACKGROUND

After a round of ammunition has been fired a casing or case of the round may be reused by reloading it with a primer, a propellant, and a bullet. One step in this process is to remove the spent primer from the case. Most modern ammunitions cases are "center-fire" cases, which have the primer located in a primer aperture in the center of the base of the case. To remove a spent primer from a center-fire ammunition case, the case must be aligned so that a force can be precisely applied at the center of the case base. Conventionally, spent primers are removed from casings by a subsystem of a multipurpose reloading apparatus, which is fixedly secured to a work table or other surface. In addition to being table-bound, these systems typically require a specialized die for each type and size of ammunition worked upon. Some hand deprimers are also known. However, these systems can also require specialized dies. Other types of hand deprimers do not use specialized dies, but it can be difficult to accurately and repeatedly position cases of different types so that a force can be precisely applied at the center of the case base.

SUMMARY

In one aspect, the present invention is directed to a hand deprimer for removing a spent primer from a cartridge case. The case has a base and an annular body including an outer surface extending along a longitudinal axis of the case between the base and a head of the case. The spent primer is located in a primer aperture in a center of the base. The hand deprimer includes a depriming shaft and a case guide. The depriming shaft has a distal end portion sized for engaging the primer and is at least partially received in the primer aperture. The depriming shaft is configured to permit selective movement of the case relative to the depriming shaft in a depriming direction to eject the primer from the base of the case. The case guide is configured for guiding the case into an operative position with respect to the depriming shaft. In the operative position, the distal end portion of the depriming shaft is oriented relative to the case to eject the primer from the base of the case when the case is moved relative to the depriming shaft in the depriming direction. The case guide includes a body engagement member configured to engage the annular body of the case and thereby secure the case in the operative position.

Other objects and features of the present invention will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
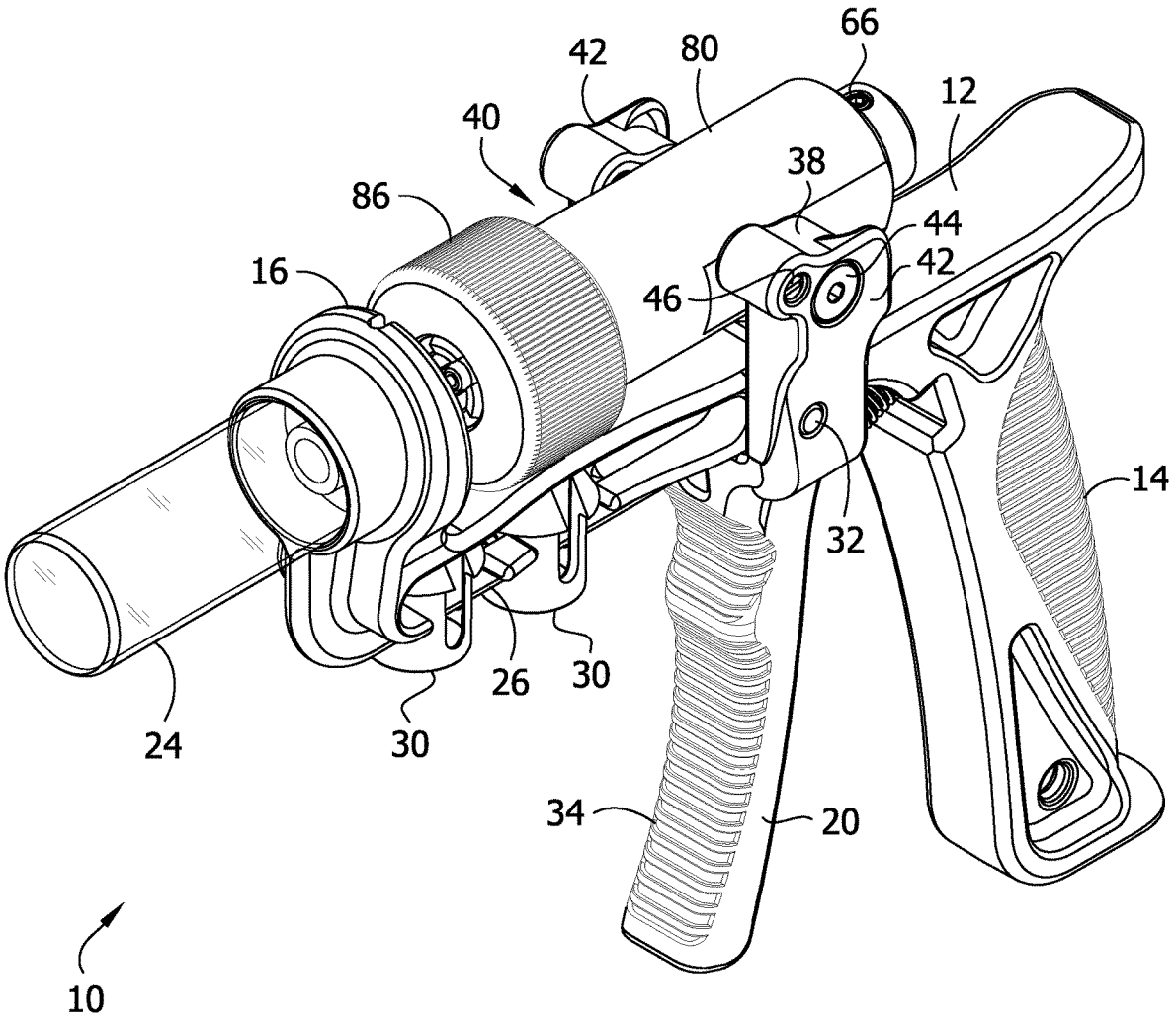
FIG. 1 is a perspective of a hand deprimer in a depriming position.
Figure 2:
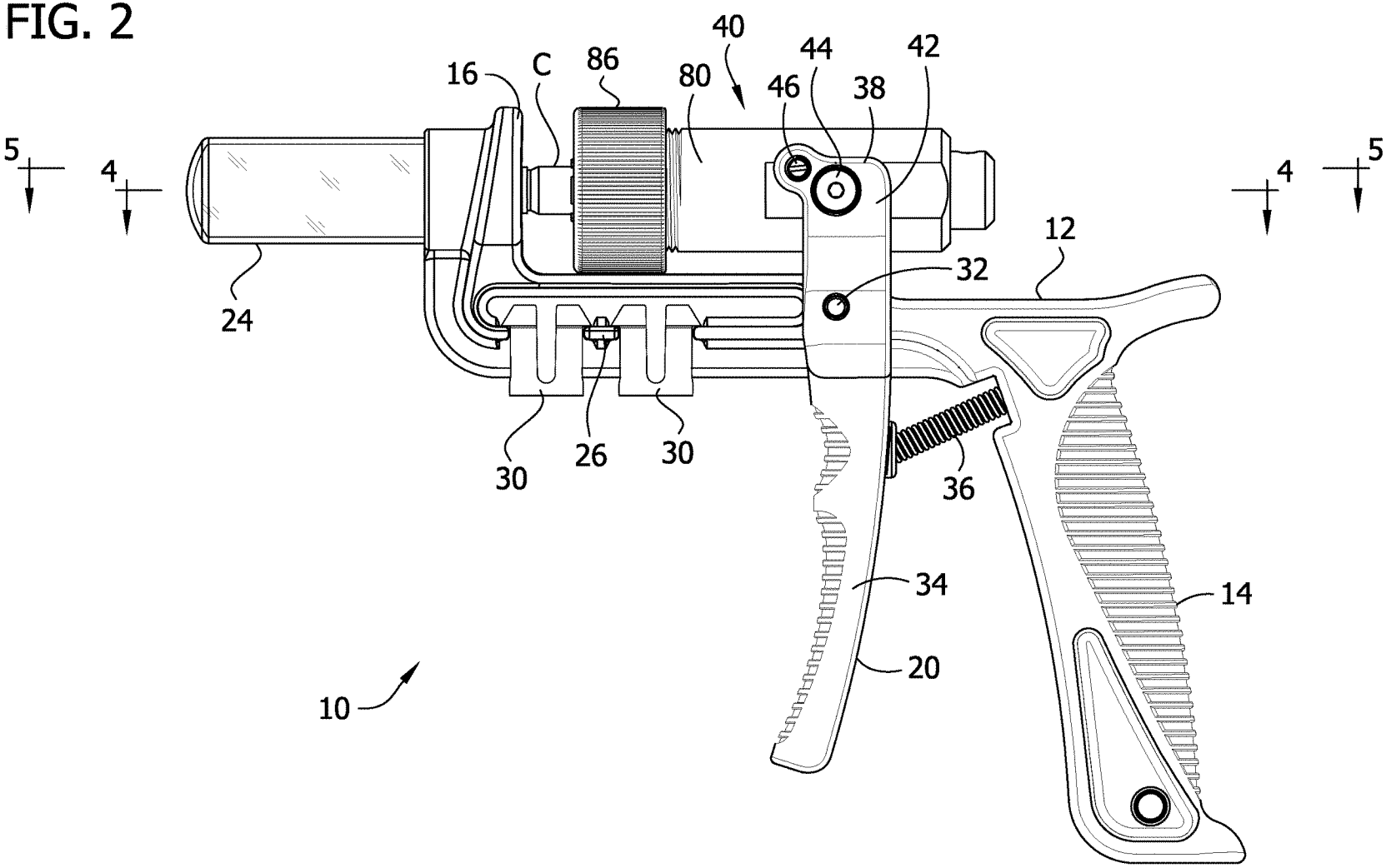
FIG. 2 is an elevation of the hand deprimer in the depriming position.
Figure 3:
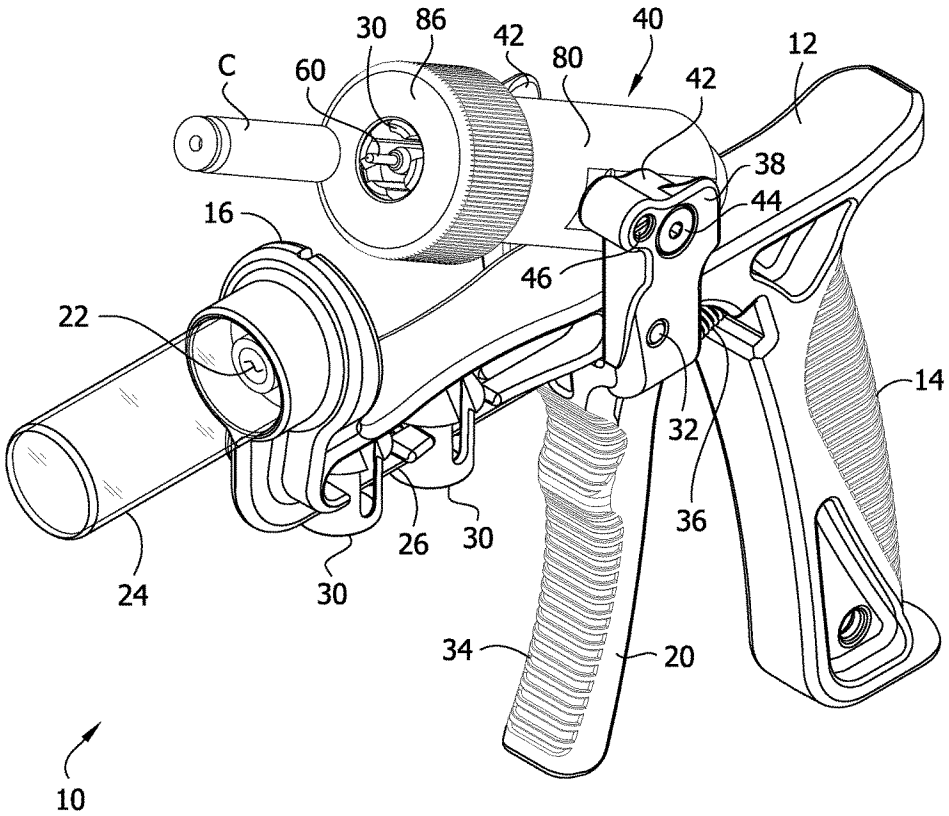
FIG. 3 is a perspective of the hand deprimer in a loading position.

Referring to FIGS. 1-3, a hand deprimer for removing a spent primer from an ammunition case C is generally indicated at reference number 10. The deprimer is hand operated and can be supported during operation by the hand of a user. As will be apparent, the deprimer 10 is a universal deprimer in that it is readily adjustable to remove the spent primer from a wide variety of sizes and types of cases. Moreover, as explained in further detail below, the deprimer 10 includes features for easily securing cases of various sizes and types in operative alignment with the deprimer. More specifically, the deprimer 10 centers cases C of various sizes and types within an enclosure to accurately align the primer with features that eject the primer from the base of the case.

Figure 4:
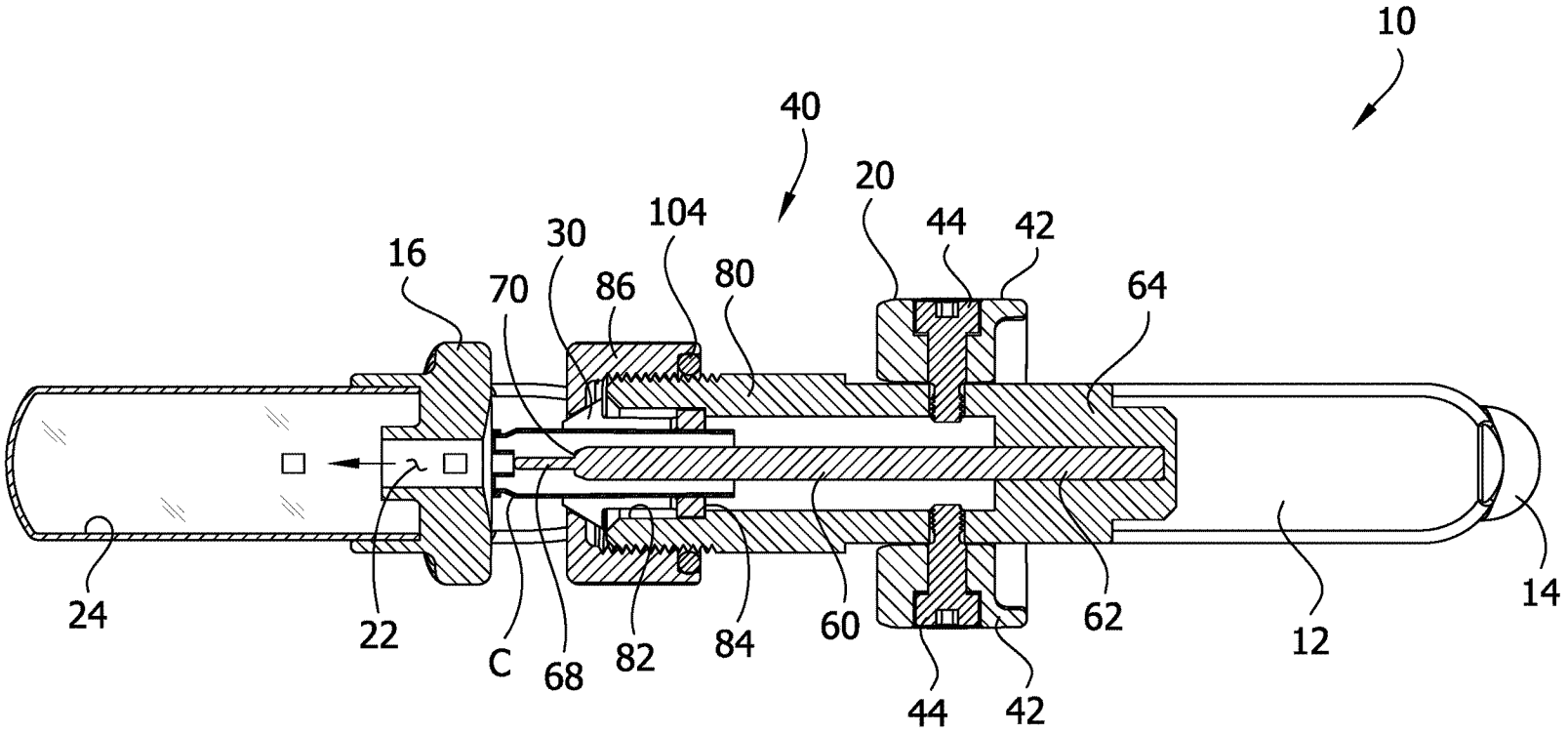
FIG. 4 is a section taken in the plane of 4-4 of FIG. 2.

The deprimer 10 includes a base 12 with a handle 14 and an anvil 16. In a preferred embodiment, the base 12 is formed as a one piece body of die-cast metal. However the base can be formed in other ways and using other materials without departing from the scope of the invention. The handle 14 of the base 12 is in the form of a pistol grip (broadly, a gripping portion). As discussed in greater detail below, a human hand grasps the pistol grip 14 and squeezes a trigger 20 (broadly, an actuator) toward the pistol grip to engage a drive mechanism that ejects the spent primer from the case C. The anvil 16 of the base 12 forms an impact member. As explained below, when the trigger 20 is actuated, the base of the case C is driven toward the impact member 16 to generate an impact that ejects the spent primer from the case. As shown in FIG. 4, an ejection passage 22 extends axially through the impact member 16 and opens toward a spent primer receptacle 24. When the hand deprimer 10 ejects the spent primer from the case C, the spent primer travels through the ejection passage 22 and into the spent primer receptacle 24. As shown in FIGS. 1-3, a collet retainer 26 of the base 12 is located between the pistol grip 14 and the impact member 16. The collet retainer 26 can hold a plurality of collets 30 (in the illustrated embodiment, two collets) used by the hand deprimer 10 in operatively aligning and holding cases C of various types and sizes. The collet retainer 26 comprises laterally extending projections arranged to engage flanged portions of the collets 30 when the collets are secured to the collet retainer.

Referring again to FIGS. 1-3, a pin 32 pivotably connects the trigger 20 to the base 12 between the pistol grip 14 and the impact member 16. A lower portion 34 of the trigger 20 is sized for engagement with a user's fingers when the thumb and palm of the hand grasps the pistol grip 14. A compression spring 36 (broadly, a resilient biasing member) resiliently biases the lower portion 34 of the trigger 20 toward a position in which it is spaced apart from the pistol grip 14, as illustrated in FIG. 2. An upper portion 38 of the trigger 20 operatively connects the base 12 to a case guide assembly 40, which, as discussed in further detail below, is configured and arranged to align and hold the case C so the base of the case extends out of a distal end portion of the case guide assembly with the spent primer radially aligned with the ejection passage 22 of the impact member 16. The trigger 20 generally forms a Y-shape, with the upper portion 38 of the trigger including two spaced apart arms 42 that extend upward from the unitary lower portion 34 on opposite sides of the base 12. The pin 32 extends through respective holes in each of the arms 42 and the base 12 to mount the trigger 20 for pivoting relative the base. As shown in FIG. 4, a screw 44 extends through a hole in the distal end portion of each arm 42 and connects the arm to a respective side of the case guide assembly 40.

Referring to FIGS. 1-4, when the user squeezes the lower portion 34 of the trigger 20, it pivots about the longitudinal axis of the pin 32 so that the lower portion of the trigger moves toward the pistol grip 14. As the trigger 20 rotates, the distal end portion 38 pivots to drive the case guide assembly 40 and case C forward toward the impact member 16 until the base end of the case impacts the impact member. Upon impact, the spent primer is ejected through the ejection passage 22 and into the spent primer receptacle 24 as discussed in further detail below. When the squeezing force on the lower portion 34 of the trigger 20 is released, the compression spring 36 resiliently biases the lower portion of the trigger 20 away from the pistol grip 14. The upper portion 38 of the trigger 20 pivots backward away from the impact member 16, drawing the case C and case guide assembly 40 away from the impact member 16.

Figure 5:
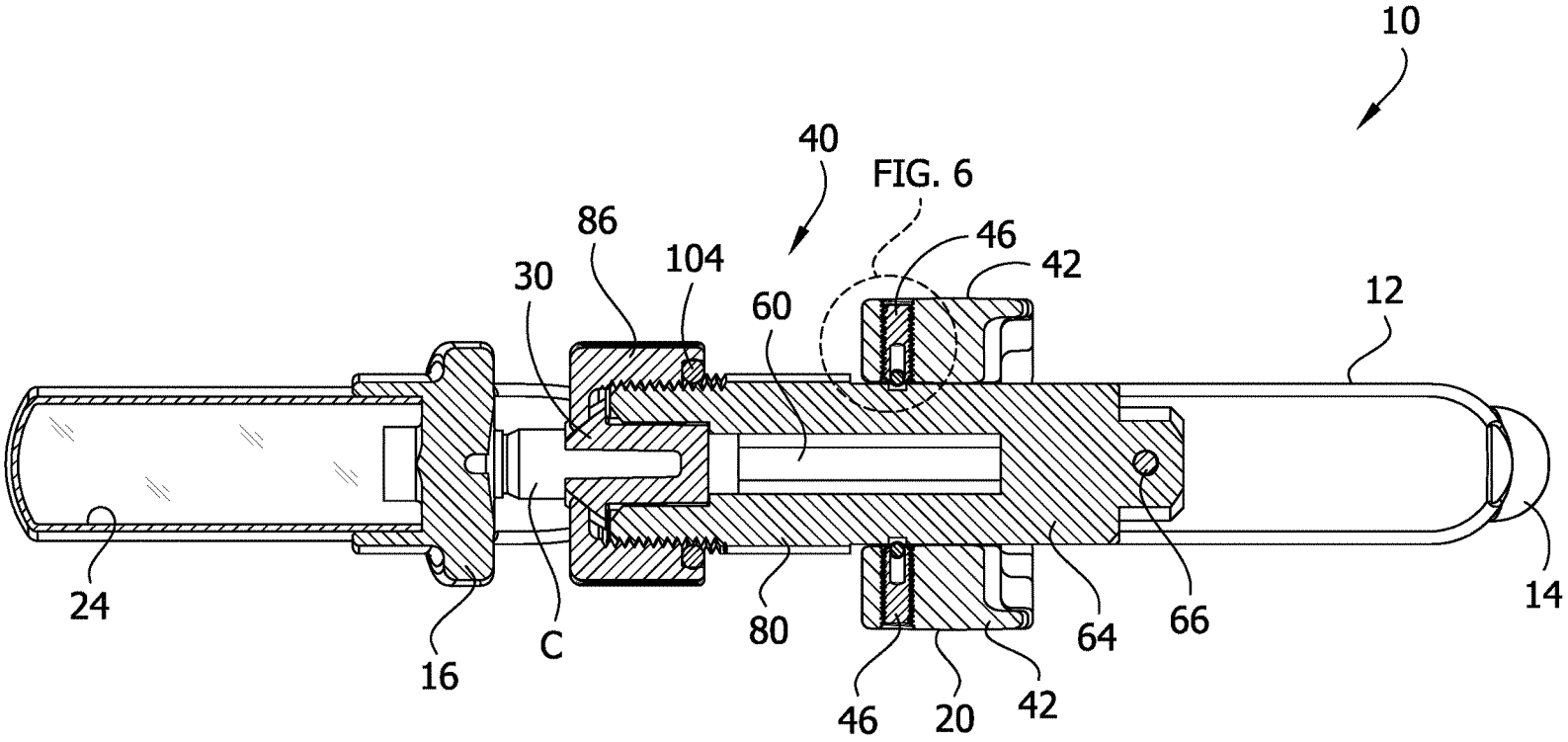
FIG. 5 is a section taken in the plane of 5-5 of FIG. 2.
Figure 6:
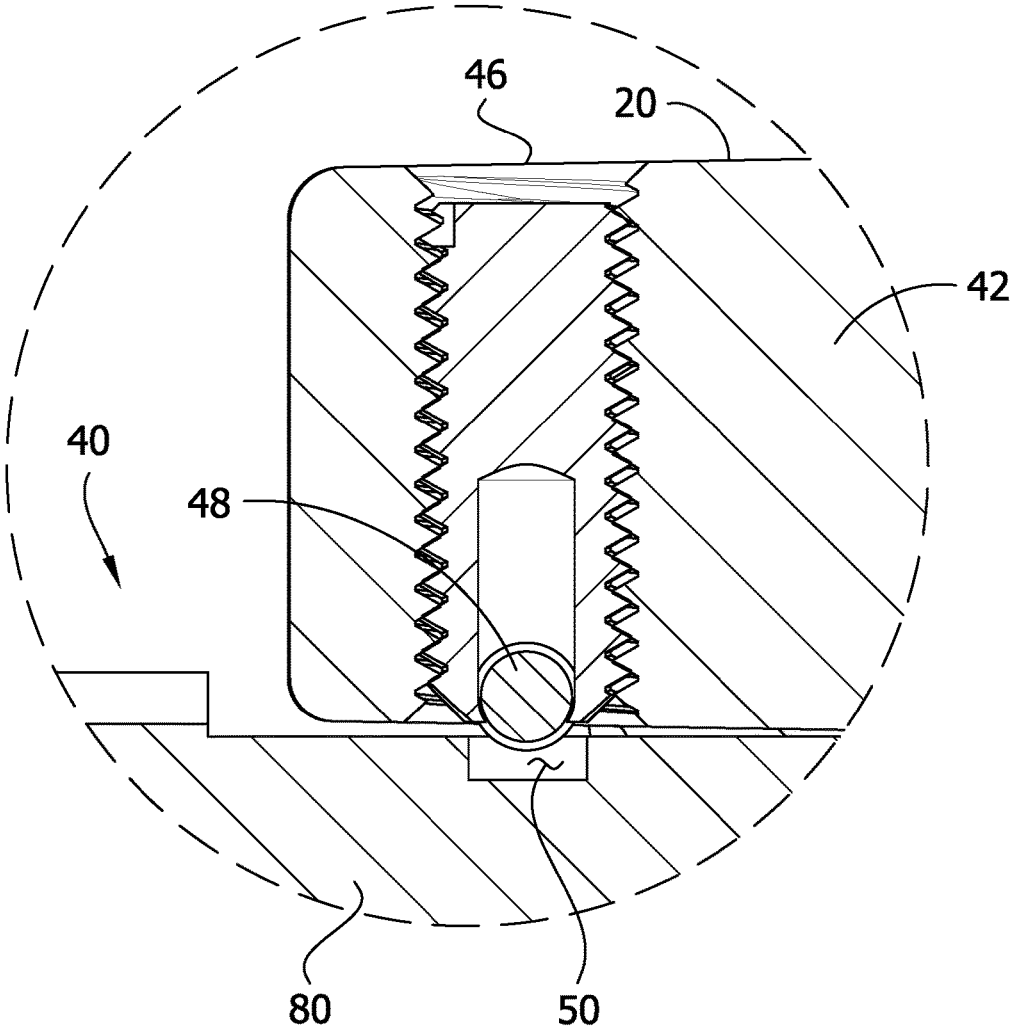
FIG. 6 is an enlarged view of a portion of the section of FIG. 5 as indicated on FIG. 5.

The case guide assembly 40 is configured to pivot about the longitudinal axis of the screws 44 between a loading position (FIG. 3) in which the case guide assembly is positioned for loading a case C and an depriming position (FIGS. 1 and 2) in which the case guide assembly is positioned for ejecting the spent primer from the case. Referring to FIGS. 5 and 6, a rolling ball tipped set screw 46 is threadably received in a threaded opening in each of the arms 42 of the trigger 20 so that a ball bearing 48 is biased by a spring (not shown) to engage a respective side wall of the case guide assembly 40. Each ball bearing 48 rolls along the respective side wall as the case guide assembly 40 pivots between the loading and depriming positions. Each side of the case guide assembly 40 includes a recess 50 configured to receive an end of the ball bearing 48 when the case guide assembly 40 is in the depriming position. The ball bearing 48 is biased by the spring (not shown) to extend into the recess 50 to prevent the case guide assembly 40 from inadvertently pivoting away from the depriming position during operation.

Figure 7:
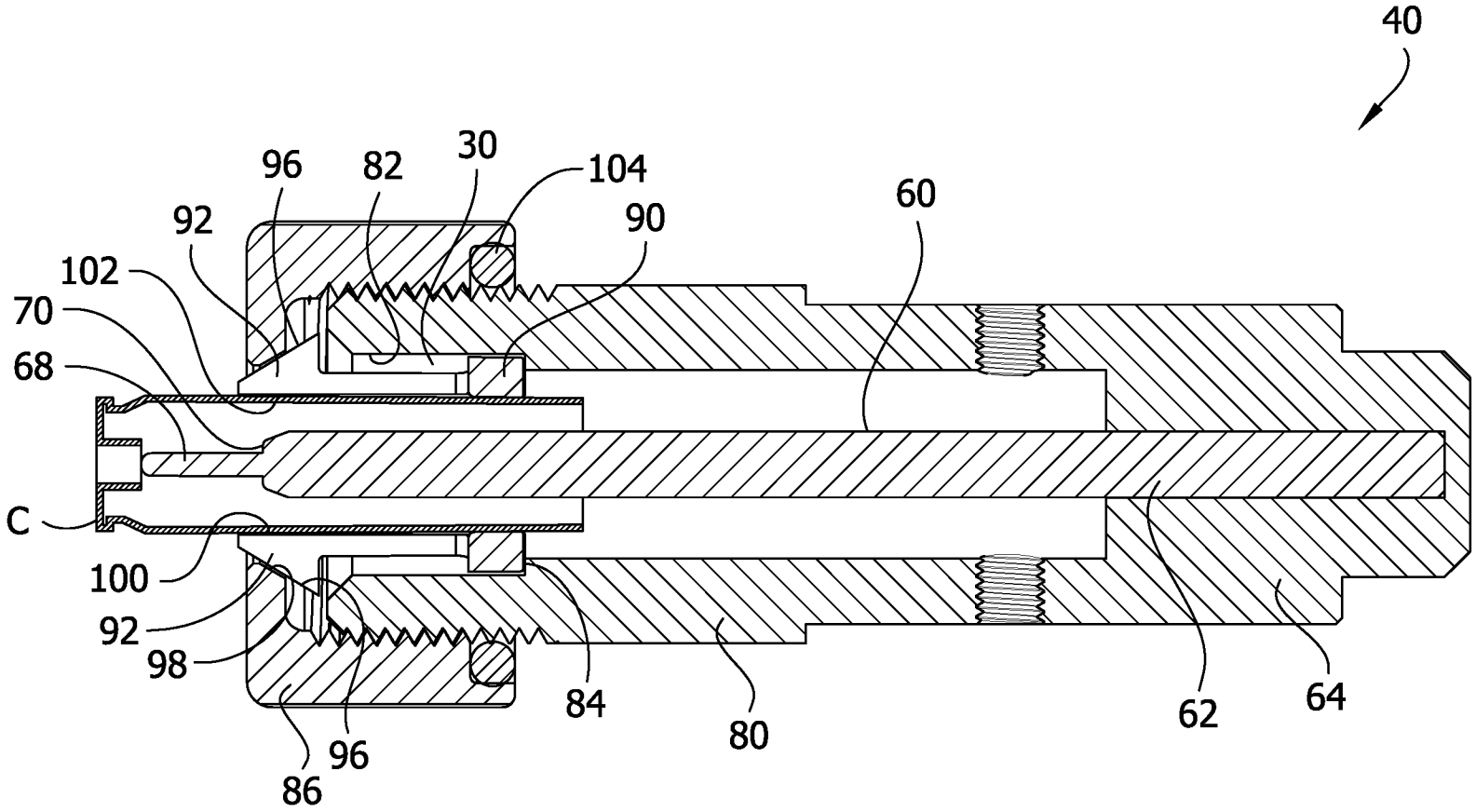
FIG. 7 is a section of a case guide assembly of the hand deprimer.

Referring to FIGS. 4 and 7, the case guide assembly 40 is configured to guide the case C to an operative position with respect to a depriming shaft 60 to eject the spent primer from the base of the case. The depriming shaft 60 extends along a longitudinal axis between opposite proximal and distal ends. A proximal end portion 62 of the depriming shaft 60 is cantilevered in an end portion 64 of the case guide assembly 40. As shown in FIG. 5, a set screw 66 is mated with a threaded aperture extending radially through the end portion 64 to secure the depriming shaft 60 at an axial position relative the case guide assembly 40. Referring again to FIGS. 4 and 7, a distal end portion 68 of the depriming shaft 60 is narrower than the proximal end portion 62. The proximal end portion 68 of the shaft 60 forms a radially outward extending shoulder 70 adjacent the distal end portion 68.

The distal end portion 68 of the depriming shaft 60 is preferably sized to extend into and through a primer aperture (i.e., the aperture in which the spent primer is disposed) in the base of the case C to eject the spent primer from the case when the hand deprimer 10 is actuated. The illustrated embodiment is configured to remove the primer from a "center-fire" ammunition case C (i.e., a case with the primer and primer aperture radially centered within the base of the case). Thus, the case guide 40 preferably aligns the longitudinal axis of the depriming shaft 60 with the longitudinal axis of the case C so that the distal end portion 68 can extend through the primer aperture. The proximal end portion 62 of the depriming shaft 60 preferably extends radially outward past the perimeter of the primer aperture so that the shoulder 70 engages the base of the case C when the distal end portion 68 is inserted through the primer aperture.

As discussed in further detail below, when the trigger 20 is squeezed against the pistol grip 14, the case guide assembly 14 and case C are driven forward until the base of the case impacts the impact member 16. Upon impact, the case C ceases its movement, but the case guide assembly 40 and depriming shaft 60 continue to be driven forward, moving forward relative the case. The distal end portion 68 of the depriming shaft 60 engages the spent primer and passes through the primer aperture, thereby ejecting the primer from the base of the case C. The annular shoulder 70 engages the base of the case C and stops further forward motion of the case guide assembly 40 and the depriming shaft 60. If the case C is not aligned properly with the depriming shaft 60, it will not be ejected as desired.

With further reference to FIGS. 4 and 7, the case guide assembly 40 is configured to guide the case C into an aligned position in which the longitudinal axis of the depriming shaft 60 is aligned with the longitudinal axis of the case. The case guide assembly 40 includes a tubular shroud 80 having a threaded end and a solid end, which forms the end portion 64 in which the depriming shaft 60 is cantilevered. The tubular shroud 80 includes a receiver configured to receive one of the collets 30 (broadly, an engagement member), which is configured to engage the annular body of the case C and thereby locate and secure the case in the aligned position. The receiver includes a generally cylindrical cavity 82 opening out of the distal end of the tubular shroud 80 and an annular shoulder 84 protruding radially inwardly between the distal and proximal ends of the shroud. The annular shoulder 84 is oriented generally perpendicular to the annular side wall of the cylindrical cavity 82. One of the collets 30 is received through the open distal end of the shroud 80 so that the proximal end of the collet engages the annular shoulder 84. A threaded cap 86 (broadly, a sizing member) is threadably received over the threaded distal end portion of the shroud 80 to retain the collet 30 in position in the receiver.

Figure 8:
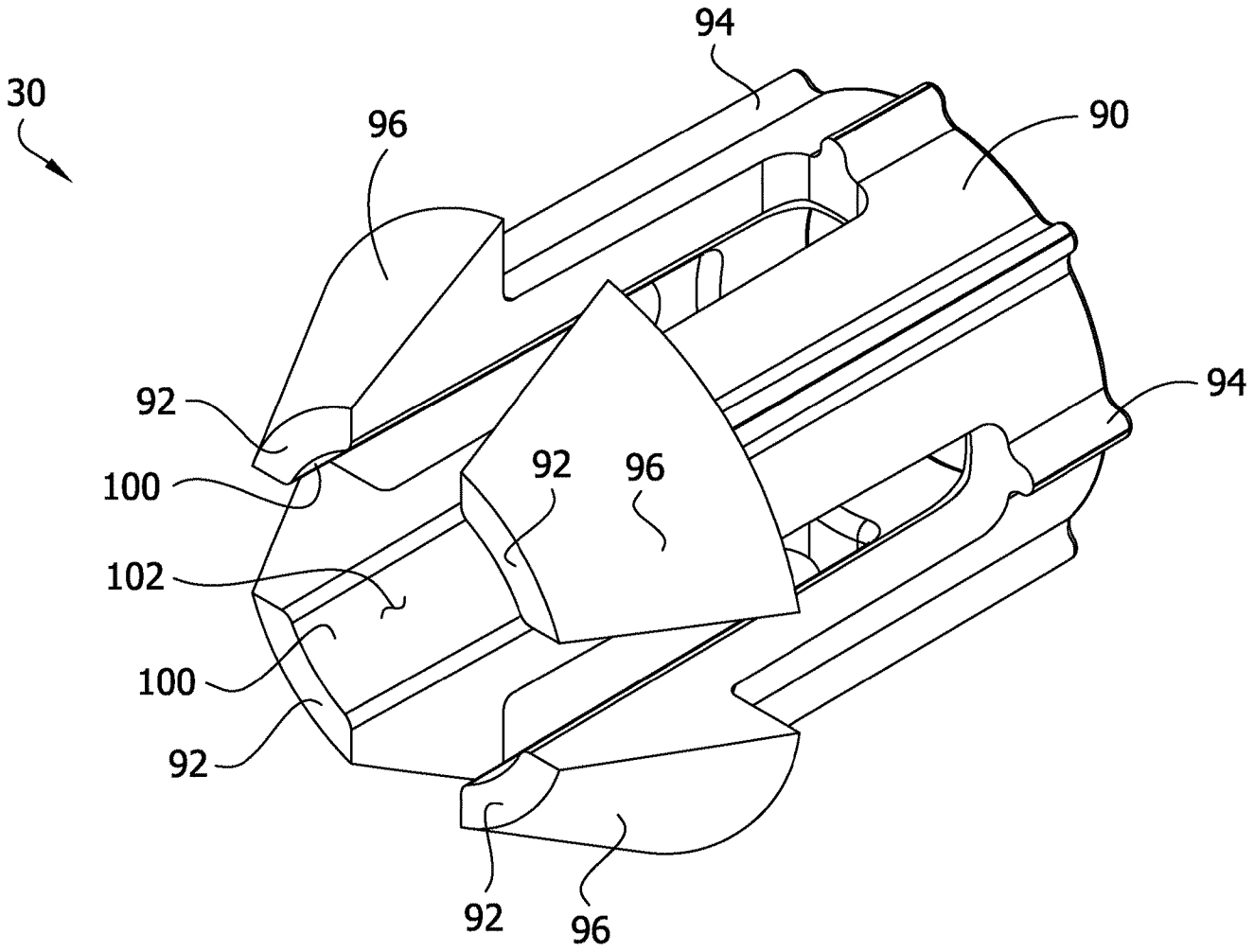
FIG. 8 is a perspective of a collet of the case guide assembly.

Referring to FIGS. 7 and 8, the collet 30 is adapted for engaging the body of the case C to center the case and thereby radially align the spent primer and primer aperture with the longitudinal axis of the depriming shaft 60. The collet 30 includes an annular portion 90 and four fingers 92 extending distally from the annular portion. Other numbers of fingers may be used without departing from the scope of the invention. The annular portion 90 of the collet 30 includes radially extending projections 94 sized for engaging the annular wall of the cylindrical cavity 82 when the collet is received in the receiver. Preferably, the radially extending projections 94 form a close tolerance fit with the receiver wall so that the collet 30 centers itself within the receiver when it is inserted therein.

The fingers 92 are spaced from one another about the circumference of the collet 30 to permit the fingers to deflect radially inward. Each finger 92 includes an outer follower surface 96, which tapers radially inward toward one end. As shown in FIG. 7, the cap 86 includes a corresponding tapered interior annular driver surface 98 extending around an opening that permits entry of the case C into the receiver. The driver surface 98 of the cap 86 engages the outer follower surfaces 96 of the fingers 92 and causes the fingers to bend radially inwardly as the cap is threaded onto the tubular shroud 80.

With further reference to FIGS. 7 and 8, each finger 92 also includes an inner engagement surface 100. The inner engagement surfaces 100 of the fingers 92 define a case receiving opening 102 sized and shaped for reception of a case therein. Preferably, the fingers 92 are radially deflectable so that the size (e.g., a width) of the case receiving opening 102 can be adjusted to operatively align a plurality of cases of different sizes and types. More preferably, the receiver of the shroud 80 can accommodate a plurality of collets 30, each of which defines a selectively adjustable case receiving opening 102 that can be adjusted across a different range of sizes to accommodate a different range of case sizes and types. In the illustrated embodiment, the hand deprimer 10 includes three interchangeable collets 30, each of which defines a case receiving opening 102 that can be adjusted across a different range of sizes to center different types of cases C within the case guide 40. Collectively the collets 30 are preferably selectively adjustable to operatively align any ammunition case of a conventional size. For example, in one or more embodiments, the collets 30 are collectively selectively adjustable to accommodate cases from .20 caliber ammunition up to .338 Lapua ammunition.

To properly align the case C with the depriming shaft 60, the case guide 40 is configured to grip the case body between the base and head of the case to generally align the longitudinal axis of the case with the longitudinal axis of the depriming shaft. Rotation of the cap 86 tending to draw the cap proximally relative the shroud 86 moves the annular driver surface 98 proximally along the follower surfaces 96 of the fingers 92. An O-ring 104 received in an annular recess at the proximal end of the cap 86 secures the cap against undesired rotation in any given position by frictional engagement with the tubular shroud 80. As the cap 86 moves proximally, the driver surface 98 engages the follower surfaces 96 to simultaneously deflect each of the fingers 92 radially inwardly in a direction transverse to the longitudinal axis of the case C to adjust the size of the case receiving opening 102. The case body engagement surfaces 100 each move in respective directions transverse to the longitudinal axis of the case as the cap 86 moves proximally of the shroud 80. The movement of the cap 86 relative the shroud simultaneously adjusts the distances between each of the case body engagement surfaces 100 and the longitudinal axis of the case C, preferably such that each of the respective distances are approximately the same as the cap moves. The cap 86 is rotated a sufficient amount to cause the fingers 92 to deflect sufficiently inward so that the engagement surface 100 of each finger engages the outer surface of the body of the case C. Engagement of the case body by the engagement surfaces 100 centers the case C in the case opening 102 and thereby generally aligns the longitudinal axis of the case with the longitudinal axis of the depriming shaft 60.

In one method of using the hand deprimer 10 to remove the primer from a cartridge case C, the user pivots the case guide assembly 40 to the loading position (FIG. 3). If the proper collet 30 (i.e., a collet whose fingers 92 can deflect radially inward to define a case opening 102 sized for centering the case C within the case guide) is not yet installed in the shroud 80, the user removes the cap 86 from the shroud 80 and inserts the proper collet 30 in the receiver until the proximal end of the collet engages the annular shoulder 84. The user threads the cap 86 partially onto the shroud 80 and inserts the case C into the case opening 102. The case C can be inserted axially into the opening 102 until it engages the distal tip of the depriming shaft 60. The case C can be inserted so that the spent primer is slightly spaced apart from the distal tip of the depriming shaft 60. With the case C received through the case opening 102, the cap 86 is threaded onto the shroud 80 to cause the cap to move onto the shroud until the engagement surfaces 100 of the fingers 92 engage the body of the case and center the case within the case opening. The user also pivots the case C to the depriming position (FIGS. 1 and 2). At this point, the case C is installed in the hand deprimer 10 in the operative position.

After the case C is guided into the operative position by the case guide assembly 40, the hand deprimer 10 can be actuated to remove the spent primer from the case C. The user squeezes the trigger 20 toward the pistol grip 14, and the case C and case guide assembly 40 move toward the impact member 16, generating an impact between the impact member and the base of the case. Preferably, the impact overcomes the frictional engagement between the engagement surfaces 100 and the body of the case C so that the case slides inwardly (i.e., in a depriming direction) relative the case guide assembly 40 and depriming shaft 60. With the case C centered in the case guide assembly 40, the distal end portion 68 of the depriming shaft 60 engages the spent primer and passes through the primer aperture. The base of the case C seals the ejection passage 22 so that, when the spent primer is ejected from the primer aperture, it passes through the ejection passage and into the spent primer receptacle 24.

As is evident, the hand deprimer 10 can be used to remove the primer from a variety of different center-fire ammunitions cases. The case guide assembly 40 is selectively adjustable to engage the body of ammunitions cases of different sizes and thereby center different sized cases within a case opening 102. The cantilevered depriming shaft 60 is continuously aligned with the center of the case opening 102. With a squeeze of the trigger 20, the case C is driven in an axial direction toward the depriming shaft 60 to eject the primer. Thus, the hand deprimer 10 provides a repeatable mechanism for removing a spent primer from different types of center-fire ammunition cases C that is easily used without being mounted to a table or other surface.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above apparatuses, systems, and methods without departing from the scope of the invention, it is intended that all matter contained in the above description and shown in the accompanying drawings shall be interpreted as illustrative and not in a limiting sense.

What is claimed is:

1. A hand deprimer for removing a spent primer from a cartridge case, the case having a base end and an annular body comprising an outer surface extending along a longitudinal axis of the case between the base end and a head end of the case, the head end including a mouth, the spent primer being located in a primer aperture in a center of the base end, the hand deprimer comprising:

a base having a handle configured for being grasped by a hand of a user to hold the deprimer while operating the deprimer, a depriming shaft supported by the base, the depriming shaft having a distal end portion, a proximal end portion, and a longitudinal axis, the distal end portion being sized for engaging the primer and being at least partially received in the primer aperture from the mouth of the case for pushing the primer out of the primer aperture, an actuator supported by the base, the actuator being operatively connected to the depriming shaft, the actuator being configured for moving the depriming shaft for removing the spent primer from the cartridge case, and a case guide supported by the base, the case guide defining a case receiving opening sized for receiving the case therein, the case guide being configured to engage the case body between the base end and the head end of the case for aligning the case with the depriming shaft.

2. A hand deprimer as set forth in claim 1 wherein the case receiving opening has a depth along which the longitudinal axis of the case extends when the case is received in the case receiving opening, the case receiving opening has a width extending transversely with respect to the depth, and the case guide includes at least two case engagement surfaces for engaging the case for aligning the case with the depriming shaft, at least one of the case engagement surfaces being movable with respect to the other of said at least two case engagement surfaces to adjust the width of the case receiving opening to correspond to a width of the case.

3. A hand deprimer as set forth in claim 1, wherein the depriming shaft is operatively coupled to the base.

4. A hand deprimer as set forth in claim 1 wherein the depriming shaft is operatively connected to the base via a pivot connection, the depriming shaft being pivotable about the pivot connection between an operative depriming position and a loading position.

5. A hand deprimer as set forth in claim 1 wherein the handle and actuator are arranged as a pistol grip and trigger, respectively.

6. A hand deprimer as set forth in claim 1 further comprising an anvil supported by the base, the anvil including a case engagement surface for engaging the base end of the case for removing the spent primer from the case, the case engagement surface facing in a first direction, the depriming shaft having an operative depriming position with respect to the anvil, the distal end portion pointing in a second direction opposite the first direction toward the anvil when the depriming shaft is in the operative position.

7. A hand deprimer as set forth in claim 6 wherein the case guide is selectively movable by the actuator toward the case engagement surface to generate an impact between the case engagement surface and the base end of the case for ejecting the primer from the primer aperture.

8. A hand deprimer as set forth in claim 6 wherein the anvil comprises an ejection passage for receiving the primer.

9. A hand deprimer as set forth in claim 6 wherein the actuator is operable to move the case guide and the depriming shaft toward the anvil for removing the primer from the primer aperture.

10. A hand deprimer for removing a spent primer from a cartridge case, the case having a base end and an annular body comprising an outer surface extending along a longitudinal axis of the case between the base end and a head end of the case, the spent primer being located in a primer aperture in a center of the base end, the hand deprimer comprising:

a base including a handle configured for being grasped by a hand of a user to hold the deprimer while operating the deprimer, an anvil supported by the base, the anvil having a case engagement surface for engaging the base end of the case for removing the spent primer from the case, a depriming shaft supported by the base, the depriming shaft having a distal end portion, a proximal end portion, and a longitudinal axis, the distal end portion being sized for engaging the primer and being at least partially received in the primer aperture for pushing the primer out of the primer aperture, a case guide supported by the base, the case guide defining a case receiving opening for receiving the case therein for aligning the case with the depriming shaft, an actuator supported by the base, the actuator being configured for decreasing a distance between the anvil and the depriming shaft for removing the spent primer from the case, and a pivot connection operatively connecting the anvil and the depriming shaft, the pivot connection permitting reconfiguration of the hand deprimer between a loading configuration for loading the case on the hand deprimer and an operative depriming configuration for removing the primer from the case.

11. A hand deprimer as set forth in claim 10 wherein in the operative depriming configuration the anvil and the depriming shaft are aligned with one another for ejecting the primer from the case upon actuation of the actuator to decrease the distance between the anvil and the depriming shaft, and in the loading configuration the anvil and the depriming shaft are out of alignment with one another for ejecting the primer from the case upon actuation of the actuator.

12. A hand deprimer as set forth in claim 11 wherein the longitudinal axis of the depriming shaft in the operative depriming configuration is aligned with the anvil, and the longitudinal axis of the depriming shaft in the loading configuration is out of alignment with the anvil.

13. A hand deprimer as set forth in claim 10 wherein the anvil comprises an ejection passage for receiving the primer, the longitudinal axis of the depriming shaft in the operative depriming configuration being aligned with the ejection passage, and the longitudinal axis of the depriming shaft in the loading configuration being out of alignment with the ejection passage.

14. A hand deprimer as set forth in claim 10 wherein the actuator is operatively connected to the depriming shaft and is configured for moving the depriming shaft toward the anvil for removing the spent primer from the cartridge case.

15. A hand deprimer as set forth in claim 10 wherein the depriming pin is operatively connected to the base via the pivot connection.

16. A hand deprimer as set forth in claim 15 wherein the case guide is operatively connected to the base via the pivot connection.

17. A hand deprimer as set forth in claim 16 wherein the case guide and the depriming shaft are pivotable conjointly about the pivot connection between the operative depriming configuration and the loading configuration.

18. A hand deprimer as set forth in claim 17 wherein the case guide comprises a sizing member selectively movable relative to the at least two case engagement surfaces to simultaneously adjust respective distances between the longitudinal axis of the depriming shaft and each of the case engagement surfaces.

19. A hand deprimer as set forth in claim 18 wherein the distances between the longitudinal axis of the depriming shaft and each of the case engagement surfaces are the same.

20. A hand deprimer as set forth in claim 18 wherein the case guide comprises a collet defining the at least two case engagement surfaces.

21. A hand deprimer as set forth in claim 20 wherein the collet comprises an annular portion and fingers extending from the annular portion, the fingers defining the case engagement surfaces.

22. A hand deprimer as set forth in claim 21 wherein the fingers define a collet follower surface and the sizing member defines a sizing member driver surface configured for opposing engagement with collet follower surface.

23. A hand deprimer as set forth in claim 22 wherein the sizing member is configured for selective movement relative to the collet in an axial direction, the sizing member driving surface engaging the collet follower surface as the sizing member moves relative to the collet in the axial direction and deflecting the fingers radially inwardly toward the longitudinal axis of the case.

24. A hand deprimer as set forth in claim 10 further comprising a detent configured to selectively maintain the hand deprimer in the operative depriming configuration.

25. A hand deprimer for removing a spent primer from a cartridge case, the case having a base end and an annular body comprising an outer surface extending along a longitudinal axis of the case between the base end and a head end of the case, the spent primer being located in a primer aperture in a center of the base end, the hand deprimer comprising:

a base having a handle configured for being grasped by a hand of a user to hold the deprimer while operating the deprimer, an anvil supported by the base, the anvil including a case engagement surface for engaging the base end of the case for removing the spent primer from the case, a depriming shaft supported by the base, the depriming shaft being configured for engaging the primer and being at least partially received in the primer aperture for pushing the primer out of the primer aperture, an actuator supported by the base, the actuator being configured for decreasing a distance between the anvil and the depriming shaft for removing the spent primer from the case, a case guide supported by the base, the case guide defining a case receiving opening for receiving the case therein for aligning the case with the depriming shaft, the case receiving opening having a depth along which the longitudinal axis of the case extends when the case is received in the case receiving opening, the case receiving opening having a width extending transversely with respect to the depth, and the case guide including at least two case engagement surfaces for engaging the case for aligning the case with the depriming shaft, at least one of the case engagement surfaces being movable with respect to the other of said at least two case engagement surfaces to adjust the width of the case receiving opening to correspond to a width of the case.

* * * * *